US008485920B2

(12) United States Patent
Breier et al.

(10) Patent No.: US 8,485,920 B2
(45) **Date of Patent: *Jul. 16, 2013**

(54) METAL WOOD GOLF CLUB HEAD

(75) Inventors: Joshua G. Breier, Vista, CA (US); Thomas C. Morris, Carlsbad, CA (US); Kevin C. Chau, San Marcos, CA (US); Scott A. Rice, San Diego, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/125,449

(22) Filed: May 22, 2008

(65) Prior Publication Data

US 2008/0227564 A1 Sep. 18, 2008

Related U.S. Application Data

(63) Continuation of application No. 11/180,406, filed on Jul. 13, 2005, now Pat. No. 7,377,860.

(51) Int. Cl.
*A63B 53/04* (2006.01)
*A63B 53/06* (2006.01)

(52) U.S. Cl.
USPC ..... 473/335; 473/345

(58) Field of Classification Search
USPC ..... 473/324–350
See application file for complete search history.

(56) References Cited

U.S. PATENT DOCUMENTS

| | | | |
|---|---|---|---|
| 1,349,806 | A | 8/1920 | Booth |
| 1,361,258 | A | 12/1920 | Horton |
| 1,412,650 | A | 4/1922 | Booth |
| 1,452,845 | A | 4/1923 | Pryde |
| 1,455,379 | A | 5/1923 | Allen |
| 1,552,297 | A | 9/1925 | Harness |
| 1,559,299 | A | 10/1925 | Barach |
| 1,574,213 | A | 2/1926 | Tyler |
| 1,575,364 | A | 3/1926 | Hodgkins |
| 1,705,997 | A | 3/1929 | Williams |
| 3,166,320 | A | 1/1965 | Onions |
| 3,556,533 | A | 1/1971 | Hollis |
| 3,941,390 | A | 3/1976 | Hussey |
| 3,966,210 | A | 6/1976 | Rozmus |

(Continued)

FOREIGN PATENT DOCUMENTS

| | | |
|---|---|---|
| JP | 08-089603 | 4/1996 |
| JP | 09-192269 | 7/1997 |

(Continued)

OTHER PUBLICATIONS

Jackson, Jeff. THe Modern Guide to Golf Clubmaking. Ohio: Dynacraft Golf Products, Inc., copyright 1994, p. 239.*

Japanese Office Action for Application No. 2007-311561, dated Jun. 30, 2010, in 7 pages.

Japanese Office Action titled Pretrial Reexamination Report for Japanese Application No. 2007-085624, (Appeal Trial No. 2010-009497), dated Jul. 7, 2010, in 6 pages.

*Primary Examiner* — Alvin Hunter

(74) *Attorney, Agent, or Firm* — Mark S. Leonardo; Brown Rudnick LLP

(57) ABSTRACT

An improved golf club head is disclosed which comprises the positioning of secondary weights at such low, rearward and outward locations that it causes an alteration in the traditional look of the club head wherein each secondary weight has a portion of the weight that bulges outwards of the natural contour of the club head.

12 Claims, 5 Drawing Sheets

U.S. PATENT DOCUMENTS

D240,644 S 7/1976 Manfrin
3,985,363 A 10/1976 Jepson et al.
4,021,047 A 5/1977 Mader
4,043,563 A 8/1977 Churchward
4,085,934 A 4/1978 Churchward
4,193,601 A 3/1980 Reid, Jr. et al.
D262,049 S 11/1981 Simmons
4,432,549 A 2/1984 Zebelean
4,438,931 A 3/1984 Motomiya
4,653,756 A 3/1987 Sato
4,762,322 A * 8/1988 Molitor et al. ..... 473/345
4,792,140 A 12/1988 Yamaguchi et al.
4,869,507 A * 9/1989 Sahm ..... 473/337
4,872,683 A 10/1989 Doran et al.
4,872,685 A 10/1989 Sun
4,883,275 A 11/1989 Broone
5,186,465 A 2/1993 Chorne
5,205,560 A 4/1993 Hoshi et al.
5,213,328 A 5/1993 Long et al.
5,255,913 A 10/1993 Tsuchida
5,272,802 A 12/1993 Stites, III
5,310,186 A 5/1994 Karsten
5,346,217 A 9/1994 Tsuchiya et al.
5,435,558 A 7/1995 Iriarte
5,447,309 A * 9/1995 Vincent ..... 473/345
5,474,297 A 12/1995 Levin
5,484,155 A 1/1996 Yamawaki et al.
5,547,188 A 8/1996 Dumontier et al.
5,624,331 A 4/1997 Lo et al.
5,665,014 A 9/1997 Sanford et al.
5,769,736 A 6/1998 Sato
5,785,609 A 7/1998 Sheets et al.
5,797,176 A 8/1998 Rose et al.
5,842,935 A 12/1998 Nelson
5,935,020 A * 8/1999 Stites et al. ..... 473/345
5,947,840 A * 9/1999 Ryan ..... 473/335
5,997,415 A 12/1999 Wood
D418,885 S 1/2000 Wanchena
6,012,989 A 1/2000 Saksun
6,059,669 A 5/2000 Pearce
6,074,308 A 6/2000 Domas
6,077,171 A 6/2000 Yoneyama
6,089,994 A 7/2000 Sun
6,123,627 A 9/2000 Antonious
6,139,446 A 10/2000 Wanchena
6,149,534 A 11/2000 Peters et al.
6,162,133 A 12/2000 Peterson
6,183,377 B1 2/2001 Liang
6,217,461 B1 4/2001 Galy
6,248,025 B1 6/2001 Murphy et al.
6,248,026 B1 6/2001 Wanchena
6,254,494 B1 * 7/2001 Hasebe et al. ..... 473/349
6,332,848 B1 12/2001 Long et al.
6,340,337 B2 * 1/2002 Hasebe et al. ..... 473/349
6,354,962 B1 3/2002 Galloway et al.
6,409,612 B1 6/2002 Evans et al.
6,422,951 B1 7/2002 Burrows
6,440,009 B1 8/2002 Guibaud et al.
6,471,604 B2 10/2002 Hocknell et al.
6,482,106 B2 11/2002 Saso
6,565,452 B2 5/2003 Helmstetter et al.
6,572,491 B2 * 6/2003 Hasebe et al. ..... 473/349
6,575,845 B2 6/2003 Galloway et al.
6,592,468 B2 7/2003 Vincent et al.
6,623,378 B2 9/2003 Beach et al.
6,645,086 B1 11/2003 Chen
6,648,773 B1 11/2003 Evans
6,716,114 B2 * 4/2004 Nishio ..... 473/314
6,739,983 B2 5/2004 Helmstetter et al.
6,739,984 B1 5/2004 Ciasullo
6,773,360 B2 8/2004 Willett et al.
6,776,723 B2 * 8/2004 Bliss et al. ..... 473/291
6,860,818 B2 3/2005 Mahaffey et al.
6,872,152 B2 3/2005 Beach et al.
6,890,267 B2 5/2005 Mahaffey et al.
6,896,625 B2 5/2005 Grace
6,902,497 B2 6/2005 Deshmukh et al.
6,913,546 B2 * 7/2005 Kakiuchi ..... 473/345
6,926,615 B1 8/2005 Souza et al.
6,929,565 B2 8/2005 Nakahara et al.
6,932,875 B2 8/2005 Cheng et al.
6,955,612 B2 10/2005 Lu
6,991,558 B2 * 1/2006 Beach et al. ..... 473/324
7,008,332 B2 3/2006 Liou
7,022,030 B2 4/2006 Best et al.
7,025,692 B2 4/2006 Erickson et al.
7,070,517 B2 7/2006 Cackett et al.
7,128,664 B2 10/2006 Onoda et al.
7,140,974 B2 11/2006 Chao et al.
7,147,573 B2 12/2006 DiMarco
7,160,040 B2 1/2007 Matsushima
7,163,468 B2 1/2007 Gibbs et al.
7,166,038 B2 * 1/2007 Williams et al. ..... 473/329
7,166,040 B2 1/2007 Hoffman et al.
7,169,060 B2 * 1/2007 Stevens et al. ..... 473/329
7,175,541 B2 2/2007 Lo
7,186,190 B1 3/2007 Beach et al.
7,204,768 B2 4/2007 Nakahara et al.
7,252,599 B2 8/2007 Haseguwa
7,258,625 B2 8/2007 Kawaguchi et al.
7,281,993 B2 10/2007 Oyama
7,303,487 B2 12/2007 Kumamoto
7,338,390 B2 3/2008 Lindsay
D567,888 S 4/2008 Soracco
7,371,191 B2 5/2008 Sugimoto
7,377,860 B2 * 5/2008 Breier et al. ..... 473/334
7,448,963 B2 * 11/2008 Beach et al. ..... 473/337
7,524,249 B2 4/2009 Breier et al.
7,530,901 B2 5/2009 Imamoto et al.
7,549,933 B2 6/2009 Kumamoto
7,632,195 B2 12/2009 Jorgensen
7,658,686 B2 2/2010 Soracco
7,753,809 B2 7/2010 Cackett et al.
7,803,065 B2 9/2010 Breier et al.
2001/0001302 A1 5/2001 Murphy et al.
2001/0049310 A1 12/2001 Cheng et al.
2002/0045490 A1 4/2002 Ezawa et al.
2002/0077195 A1 6/2002 Carr et al.
2002/0137576 A1 9/2002 Dammen
2002/0160858 A1 10/2002 Lee
2003/0045371 A1 3/2003 Wood et al.
2003/0100381 A1 5/2003 Murphy et al.
2003/0134690 A1 7/2003 Chen
2003/0144078 A1 7/2003 Setokawa et al.
2003/0162608 A1 8/2003 Chen
2004/0138002 A1 7/2004 Murray
2004/0176177 A1 9/2004 Mahaffey et al.
2004/0192468 A1 9/2004 Onoda et al.
2004/0242343 A1 12/2004 Chao et al.
2004/0254030 A1 12/2004 Nishitani et al.
2005/0119070 A1 6/2005 Kumamoto
2005/0159243 A1 7/2005 Chuang
2005/0170907 A1 8/2005 Saso
2005/0215354 A1 9/2005 Kumamoto
2005/0272527 A1 12/2005 Sugimoto
2006/0014592 A1 1/2006 Sugimoto
2006/0052177 A1 3/2006 Nakahara et al.
2006/0052181 A1 3/2006 Serrano et al.
2006/0058112 A1 * 3/2006 Haralason et al. ..... 473/334
2006/0100032 A1 5/2006 Imamoto et al.
2006/0116218 A1 6/2006 Burnett et al.
2007/0054751 A1 3/2007 Breier et al.
2007/0060414 A1 3/2007 Breier et al.
2008/0070721 A1 3/2008 Chen et al.
2008/0242445 A1 10/2008 Mergy et al.
2008/0268980 A1 10/2008 Breier et al.
2010/0041490 A1 2/2010 Boyd et al.
2010/0105499 A1 4/2010 Roach et al.
2010/0130304 A1 5/2010 Soracco
2010/0130305 A1 5/2010 Soracco

FOREIGN PATENT DOCUMENTS

JP 2000-024149 1/2000
JP 2002-336389 11/2002
JP 2003-093554 4/2003
JP 2003-310808 11/2003
JP 2004-121744 4/2004

| | | |
|---|---|---|
| JP | 2004-159680 | 6/2004 |
| JP | 2004-337327 | 12/2004 |
| JP | 2006-025929 | 2/2006 |
| JP | 2006-130065 | 5/2006 |
| WO | WO 2004-052472 | 6/2004 |

* cited by examiner

METAL WOOD GOLF CLUB HEAD

CROSS-REFERENCE TO RELATED APPLICATIONS

This is a continuation of U.S. patent application Ser. No. 11/180,406, filed on Jul. 13, 2005 now U.S. Pat. No. 7,377, 860, the disclosure of which is incorporated herein by reference in its entirety.

FIELD OF THE INVENTION

The present invention relates generally to a metallic hollow golf club head, and specifically, to the placement of secondary weights.

BACKGROUND OF THE INVENTION

Golf club "metal woods", were originally manufactured primarily by casting of durable metals such as stainless steel, aluminum, beryllium copper, etc. into a unitary structure comprising of a metal body, face and hosel. As technology progressed it became more desirable to strengthen the face of the club, and usually this was achieved by using a titanium material.

With a high percentage of amateur golfers constantly searching for more distance on their drives, the golf industry has responded by providing golf clubs specifically designed to increase distance. The head sizes have increased, which allows for the club to possess a higher moment of inertia, and this translates to a greater ability to resist twisting on off-center hits. As a wood head becomes larger, its center of gravity will be moved back away from the face and further toward the toe resulting in hits flying higher and to the right than expected (for right-handed golfers). Reducing the lofts of the larger head clubs can compensate for this. Also the larger heads, because the center of gravity is moved further away from hosel axis, can cause these clubs to remain open on contact, thereby inducing a "slice" effect (in the case of a right-handed golfer the ball deviates to the right). Offsetting the head and incorporating a hook face angle can help compensate for this by "squaring" the face at impact, but often more is required to eliminate the "slice" tendency. The present invention provides such a solution.

Another technological breakthrough in recent years towards providing the average golfer with more distance is to make larger head clubs, while keeping the weight constant or even lighter, by casting consistently thinner shell thickness and going to lighter materials such as titanium, magnesium and composites. Also the faces of the clubs have been steadily becoming extremely thin, wherein the thinner face will maximize what is known as the COR (Coefficient of Restitution). The more a face rebounds upon impact, the more energy that may be imparted to the ball, thereby increasing distance.

The prior art teaches methods to enhance the weight distribution of metal woods to help reduce the club from being open on contact with the ball. Usually, this is accomplished by the addition of weights to the body casting itself or strategically adding a weight element at some point in the club. Many efforts have been made to incorporate weight elements into the metal wood head. They are usually placed at specific locations, which will have a positive influence on the flight of the ball or to overcome a particular golfer's shortcomings. As previously stated, a major problem area of the higher handicap golfer is the tendency to "slice" which besides deviating the ball to the right, also imparts a greater spin to the ball which reduces overall distance. To reduce this tendency, the present patent teaches the placing of weight elements directly into the club head. The placement of weight elements is designed so that the spin of the ball will be reduced, and also a "draw" (a right to left ball flight for a right-handed golfer) will be facilitated into the ball flight. This ball flight pattern is also designed to help the distance challenged golfer because a lower spinning ball will generally roll a greater distance after hitting the ground than it would roll with a higher spin. The present invention provides such a golf club.

SUMMARY OF THE INVENTION

In accordance with one aspect of the invention, a metal wood golf club head is provided which includes a substantially hollow club head having a metal front face welded to it, a sole plate, a crown portion, a toe portion, a heel portion, and secondary weights in a location back from the front face portion. A center point on the sole plate defines the lowest point on the club head and it is located directly below the center of gravity of the club head when the club head is at about a 59° lie. The center of gravity of the secondary weights are positioned a pre-determined distance from the center point. Each center of gravity is at least 0.5 inch rearward of the center point; at least 0.75 inch from the center point toward the heel for the heel weight; at least 0.75 inch for the toe weight; and a maximum 0.25 inch above the center point, whereby the weights interface with the club head at a generally concave region so that each of the secondary weights bulges outwards of the natural contour of the club head.

One embodiment provides a method of positioning the secondary weights by reference to a point wherein the centerline of the hosel intersects the sole plate. This distance is then measured from the back surface of the front face at the midpoint of the front face to determine an intersection point. The secondary weights are each at least 1.50 inches rearward of the intersection point, at least 0.75 inch toward either the heel or the toe, and a maximum of 0.25 inch above the center point with the club head at about a 59° lie.

DETAILED DESCRIPTION OF THE PREFERRED EMBODIMENTS

Figure 1:
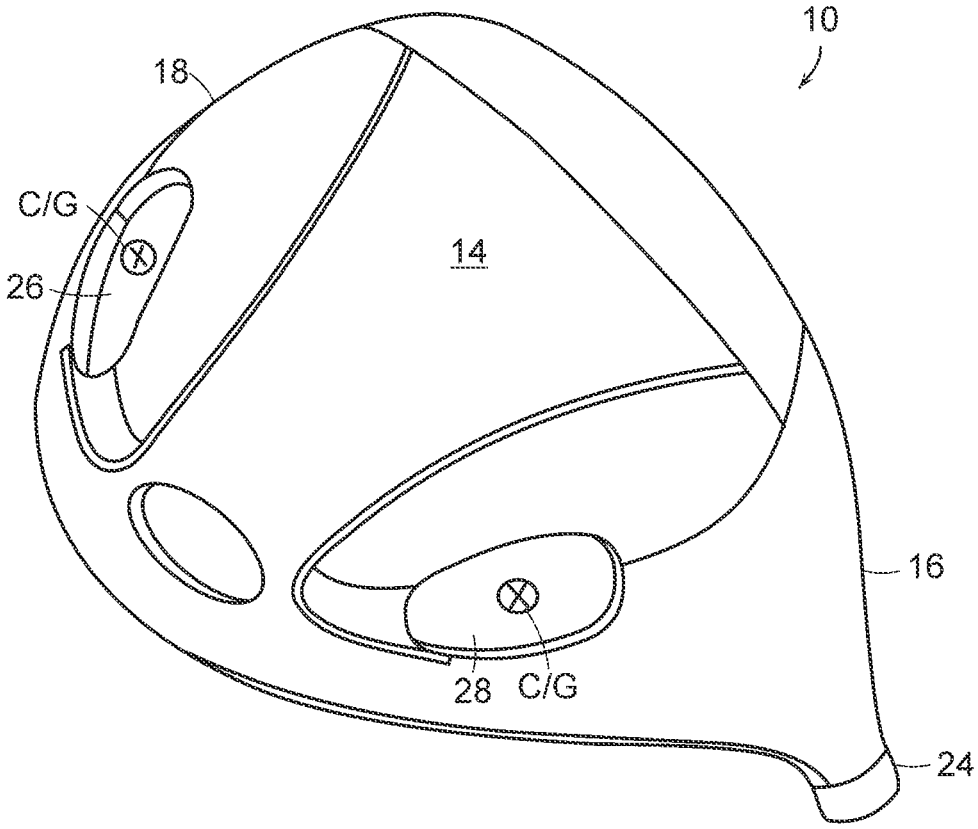
FIG. 1 is a bottom perspective view of the club head of the present invention.
Figure 2:
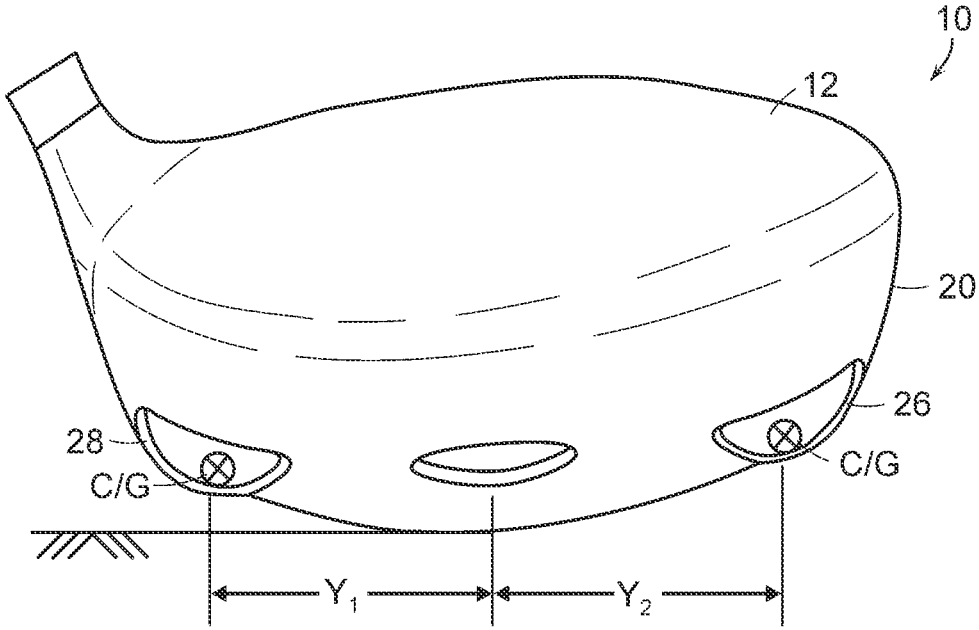
FIG. 2 is a rear elevational view of the club head of the present invention.
Figure 3:
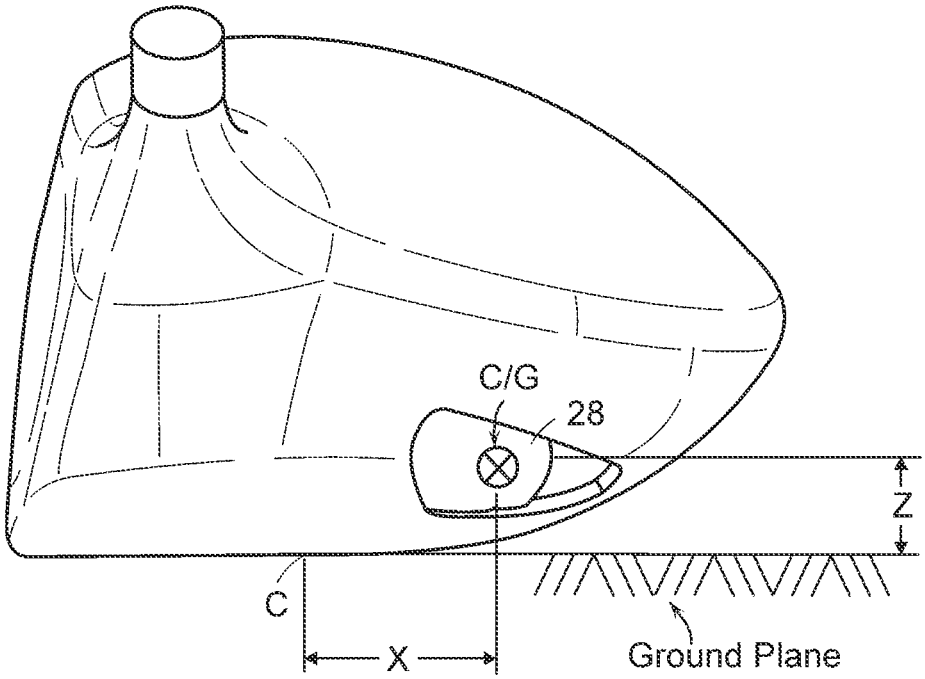
FIG. 3 is a heel elevational view thereof.

In FIGS. 1-5, there is provided a substantially hollow golf club head 10. The head 10 includes a crown portion 12, a sole plate 14, a heel portion 16, a toe portion 18, a skirt portion 20 connecting the heel portion 16 to the toe portion 18, a front face 22 and a hosel 24 that extends from the heel portion 16. The club head 10 can be formed from sheets welded together or cast, preferably from a titanium alloy. The crown portion 12 can be made from such materials as carbon fiber composite, polypropylene, Kevlar, magnesium, or a thermoplastic. Hosel 24 includes a bore defining a centerline axis C/L.

Figure 4:
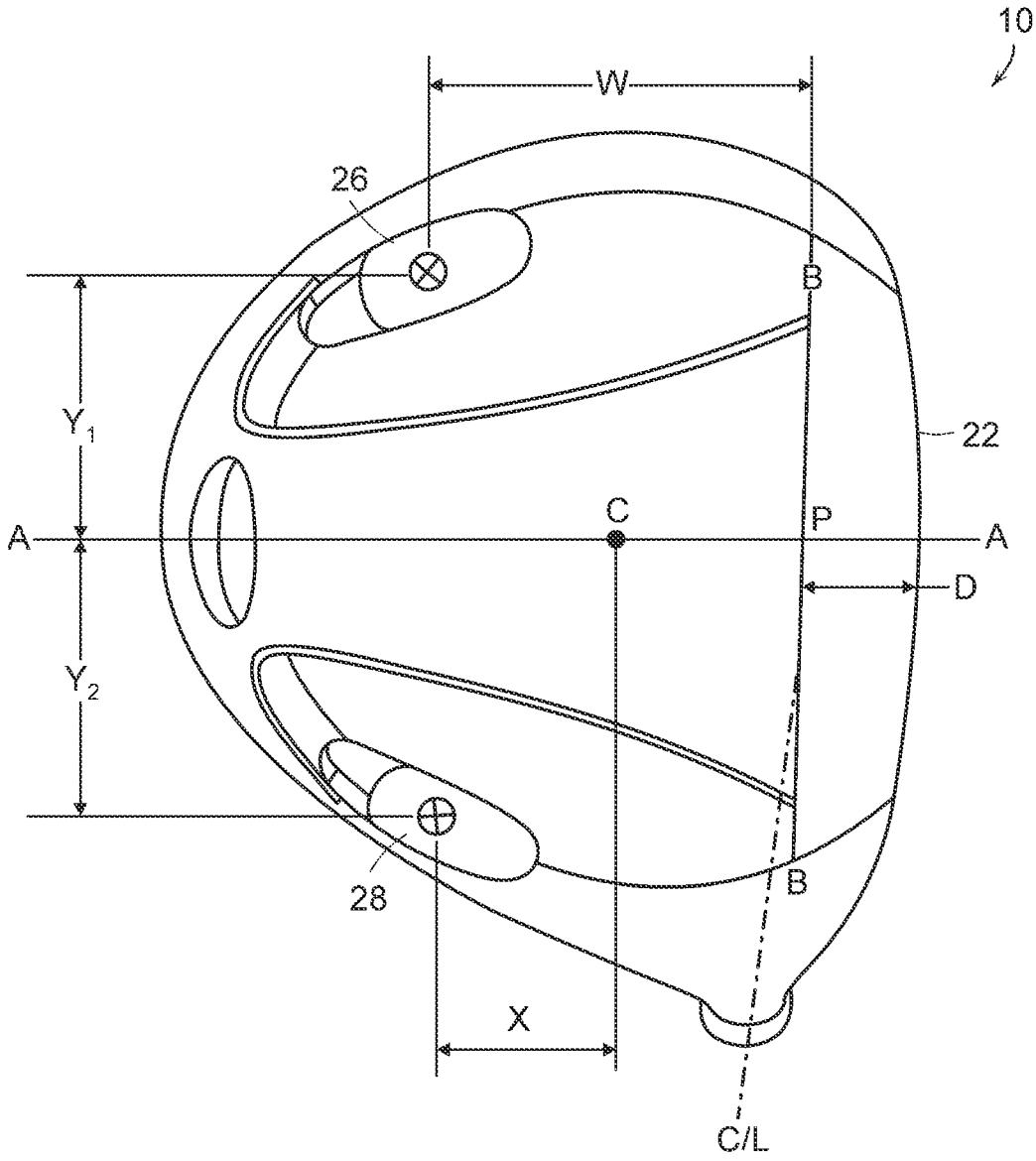
FIG. 4 is a bottom schematic view thereof.
Figure 5:
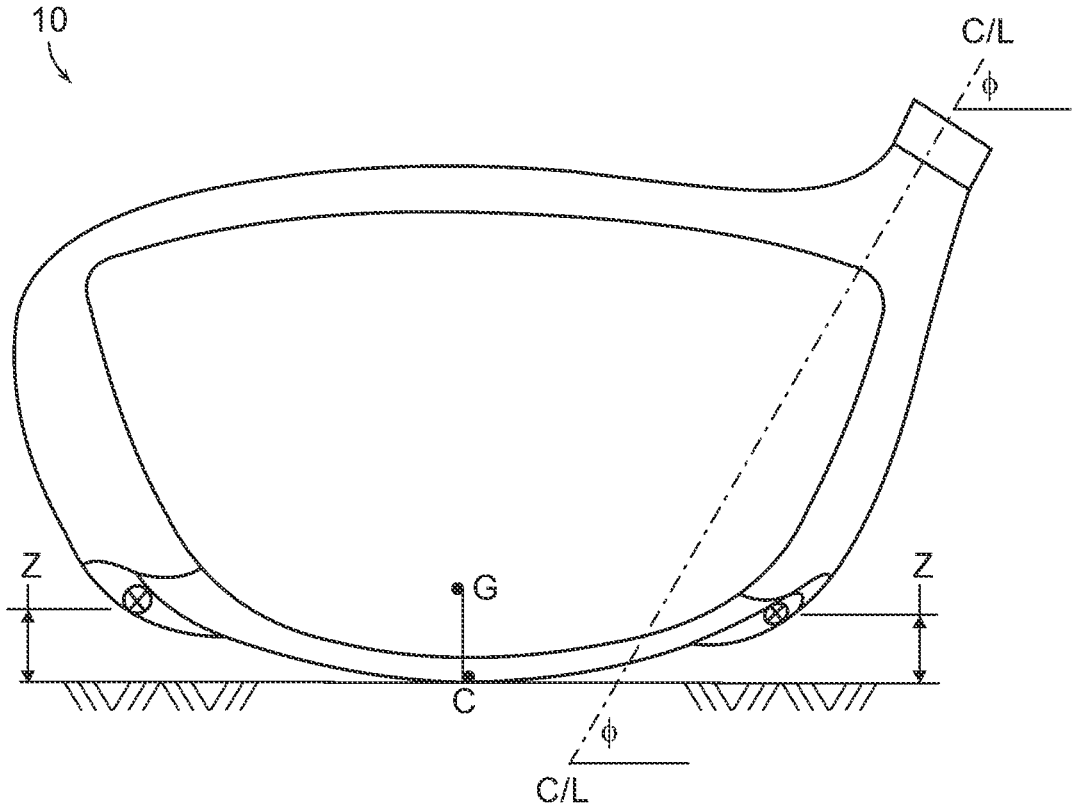
FIG. 5 is a front cross-sectional view thereof.

As best depicted in FIG. 5, the club head 10 of the present invention has a center of gravity (G) located at an extremely rearward and low position. The center of gravity (G) being created by the location of two secondary weights, a toe secondary weight 26, and a heel secondary weight 28 which are both partially outside the traditional look of a club head. As shown in FIGS. 1-5, the locations of the two secondary weight elements 26, 28 are established by the relationship of their distances from established points of contact. When the club head is at a lie angle ø of 59°, the lowest contact point of the sole plate 14 is at a center point (C) directly beneath the center of gravity (G).

One method of establishing the locations of the secondary weights 26, 28 is discussed herein. As shown in FIG. 4, the center line C/L of hosel 24 intersects the sole plate 14 at a distance (D) from the rear surface of the front face 22. When extending a substantially parallel line B-B (maintaining the distance (D), an intersection point (P) is made with a line A-A that is perpendicular to and extends rearward from the midpoint of the front face 22. The line A-A extends through the middle of the club head 10 and passes directly beneath the club head center of gravity (G). The center of gravity (CIG) of each secondary weight 26, 28 is: at a distance W which is at least 1.50 inches rearward of the intersection point (P); a distance Z which is a maximum of 0.25 inch above the lowest point of contact which is the center point (C) of the sole plate 14; and, each secondary weight is at least 0.75 inch away from line A-A in opposing directions which is a distance $Y_2$ towards the toe for the toe secondary weight 26 and a distance $Y_1$ towards the heel for the heel secondary weight 28.

The locations of the secondary weights 26, 28 may also be determined for the present invention by measuring from the center point (C). From center point (C) the center of gravity of each secondary weight 26, 28 is: a distance X which is at least 0.50 inch rearward along line A-A; the distance Z which is a maximum of 0.25 inch above the center point (C); and they are each a minimum of 0.75 inch away from line A-A in opposing directions which is towards the toe for the toe secondary weight 26 and towards the heel for the heel secondary weight 28. Thus each secondary weight 26, 28 is a minimum of 0.90 inch from the center point (C).

The secondary weights 26, 28, can be selected from a plurality of weights designed to make specific adjustments to the head weight. They can be welded into place or attached by a bonding agent. The weights 26, 28, can be formed from typically heavy weight inserts such as steel, nickel or tungsten. The body of the club head 10 is preferably formed from titanium and the crown portion 12 made from a lightweight material such as carbon fiber composite, polypropylene, Kevlar, thermoplastic, magnesium, or some other suitable lightweight material. The volume of the club head 10 ranges from 350 cc to 460 cc. The secondary weights 26, 28, range in weight from 10 grams to 35 grams. It is well known that by varying parameters such as shaft flex points, weights and stiffness, face angles, and club lofts, it is possible to accommodate a wide spectrum of golfers. But, the present invention addresses the most important launch consideration which is to optimize the club head's mass properties (center of gravity and moment of inertia) by creating a center of gravity that is low, rearward and wide of center. The club head 10 of the present invention encompasses areas of the club head that are not typically utilized for weighting since they adversely alter the traditional look of a club head. The design of this club head 10 allows for a portion of the secondary weights 26, 28, to bulge outside the normal contour of the club head.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A driver golf club head comprising:

a face, a crown, a toe, a heel, and a sole, wherein, when the club head is at address, the sole has a downward convex predominant curved surface with a toe portion of the sole curving up towards the toe and a heel portion of the sole curving up towards the heel;

two weight pockets comprising bulges outside of the sole;

a weight in each pocket comprising a center of gravity that is outside of the predominant curved surface of the sole;

an idealized line A-A perpendicular to, and extending rearward from, a midpoint of the face, wherein line A-A is horizontal when the club head is at address;

an idealized heel-toe line B-B that comprises the intersection of a hosel axis with the sole, wherein line B-B is horizontal when the club head is at address and line A-A intersects line B-B to define intersection point P, wherein a center of gravity of each weight is at least 1.5 inches rearward of the intersection point P, at least 0.75 inch from the intersection point P in a heel-toe direction, and no more than 0.25 inches above a center point on the sole.

2. The golf club head of claim 1, wherein a club head volume is above 350 cc.

3. The golf club head of claim 1, wherein the weights are formed from tungsten or nickel or steel.

4. The golf club head of claim 1, wherein the crown portion is made from a lightweight material selected from the group consisting of carbon fiber composite, polypropylene, or magnesium.

5. A metal wood golf club head adapted for attachment to a shaft comprising:

a substantially hollow club head including a heel portion, a toe portion, a crown portion, a sole plate, and a front face;

a heel secondary weight and a toe secondary weight, each secondary weight having a center of gravity positioned within a concave region of the sole plate that is concave as viewed from an inside of the club head, wherein each concave region defines a bulge outward of a natural contour of the club head and wherein a center of gravity of each secondary weight is outside of the natural contour of the club head, and further wherein the center of gravity of each secondary weight is at least 0.5 inch rearward of a center point of the sole plate that defines a lowest point on the club head when the club head is at address, at least 0.75 inch from the center point in a heel-toe direction, and at least 0.25 inch above the center point.

6. The golf club head of claim 5, wherein the club head volume is between 350 cc and 460 cc.

7. The golf club head of claim 5, wherein the secondary weights comprise one selected from the list consisting of tungsten, steel, and nickel.

8. The golf club head of claim 5, wherein the crown portion comprises one selected from the group consisting of carbon fiber composite, polypropylene, or magnesium.

9. A driver golf club head comprising:

a face, a crown, a toe, a heel, and a sole, wherein, when the club head is at address, the sole has a downward convex predominant curved surface with a toe portion of the sole curving up towards the toe and a heel portion of the sole curving up towards the heel;

two weight pockets comprising bulges outside of the sole;

a weight in each pocket comprising a center of gravity that is outside of the predominant curved surface of the sole;

an idealized line A-A perpendicular to, and extending rearward from a midpoint of, the face, wherein line A-A is horizontal when the club head is at address;

an idealized heel-toe line B-B that comprises the intersection of a hosel axis with the sole, wherein line B-B is horizontal when the club head is at address and line A-A intersects line B-B to define intersection point P, wherein a center of gravity of each weight is at least 1.5 inches rearward of the intersection point P and at least 0.75 inch from the intersection point P in a heel-toe direction.

10. The golf club head of claim 9, wherein a club head volume is above 350 cc.

11. The golf club head of claim 9, wherein the weights are formed from tungsten or nickel or steel.

12. The golf club head of claim 9, wherein the crown portion is made from a lightweight material selected from the group consisting of carbon fiber composite, polypropylene, or magnesium.

* * * * *